US005140218A

United States Patent [19]

Van Eck

[11] Patent Number: 5,140,218

[45] Date of Patent: Aug. 18, 1992

[54] CATHODE RAY TUBE COMPRISING AN ELECTRON GUN

[75] Inventor: Arnoldus H. M. Van Eck, Eindhoven, Netherlands

[73] Assignee: U.S. Philips Corporation, New York, N.Y.

[21] Appl. No.: 682,802

[22] Filed: Apr. 8, 1991

[30] Foreign Application Priority Data

Apr. 20, 1990 [NL] Netherlands ..... 9000943

[51] Int. Cl.[5] ..... H01J 29/50; H01J 29/48

[52] U.S. Cl. ..... 313/414; 313/417; 313/457; 445/34; 445/36; 65/59.7

[58] Field of Search ..... 313/411, 414, 417, 409, 313/451, 456, 457; 445/34, 36; 65/59.7

[56] References Cited

U.S. PATENT DOCUMENTS

| | | | |
|---|---|---|---|
| 4,096,408 | 6/1978 | Bozzay et al. | 313/457 |
| 4,649,317 | 3/1987 | Opresko | 313/457 |
| 4,855,639 | 8/1989 | Van Eck | 313/457 |

*Primary Examiner*—Donald J. Yusko
*Assistant Examiner*—Diab Hamadi
*Attorney, Agent, or Firm*—Robert J. Kraus

[57] ABSTRACT

A cathode ray tube comprising an electron gun having a number of electrodes with securing members and a number of supports of electrically insulating material, said supports and electrodes being interconnected by means of serrated clamping members. By virtue of this construction, the microphonic behavior of the electron gun is improved.

16 Claims, 3 Drawing Sheets

CATHODE RAY TUBE COMPRISING AN ELECTRON GUN

BACKGROUND OF THE INVENTION

This invention relates to a cathode ray tube comprising an electron gun having at least one electrode and at least one support composed of a material which can be softened, the support and the electrode being interconnected.

A cathode ray tube of this type is known from U.S. Pat. No. 4,096,408. In said patent, a description is given of a cathode ray tube comprising an electron gun having electrodes and supports. The supports and the electrodes are interconnected.

Cathode ray tubes are used, inter alia, in display devices such as, for example, colour televisions, oscilloscopes, projection televisions and DGD (Data Graphic Display) apparatuses.

A factor which is important to the quality of an electron gun is its sensitivity to vibrations, the so-called microphonic behaviour. Vibrations can be caused by external influences, for example, by sound vibrations which are transmitted to the electron gun or by conditions inside the electron gun, for example, varying electric voltages between the electrodes. Vibrations disturb the mutual positioning of the electrodes, thus causing the position and intensity of the electron beam(s) generated by the electron gun to be subject to time-dependent variations. As a result thereof, images produced by the electron beam(s) on, for example, a display screen of the cathode ray tube are subject to time-dependent variations which adversely affect picture quality.

SUMMARY OF THE INVENTION

One of the objects of the invention is to provide a cathode ray tube of the type mentioned in the opening paragraph which exhibits an improved microphonic behaviour.

For this purpose, the cathode ray tube according to the invention is characterized in that the electrode is provided with a serrated clamping member in which the support is held, the serrations in the clamping member clamping said support at the periphery of the support.

In the known cathode ray tubes, one or more projections are pressed into a support after which the projection(s), which has (have) expanded as a result of the heat, cool(s) down and become(s) clamped in the support.

The present invention relates to changing the electrode such that during the pressing together of the support and the electrode, the support can be pressed into the serrated clamping member. Said clamping member encloses a large portion of the circumference of the support and the electrode is fixed at the periphery of the support by means of the serrations in the clamping member.

In this manner, an improved connection between the electrode and the support is obtained. By virtue of the larger clamping area, the provision of several clamping points instead of one pair and a larger distance between said clamping points, the connection has a greater stability. Also the stability of the support is greater because the serrations do not penetrate the support as deeply as in the known projections. By virtue thereof, a more stable construction and an improved microphonic behaviour of the electron gun is obtained.

The shape of the support preferably corresponds to that of the clamping member.

By virtue thereof, a further improved connection between the electrodes and the supports is obtained.

In an embodiment, the bottom of the clamping member is smaller than or equally as large as the front side of the clamping member and the serrations are provided between the bottom and the front side of said clamping member.

Preferably, a hillock is formed on the bottom of the clamping member, which causes the material of the support to be urged to serrations located close to the bottom of the clamping member during the pressing together of the electrode and the support. This results in an improved connection between the electrodes and the support.

Preferably, the serrations are formed such that the distance between the serrations, as a function of the distance to the bottom of the clamping member in a direction transverse to the bottom, exhibits local minima.

This results in an improved connection between the electrode and the support.

In an embodiment, the electron gun comprises more than one electrode and more than one support.

The invention also relates to a method of manufacturing a cathode ray tube, in which electrodes of an electron gun and supports of softenable material are interconnected in a manufacturing step by heating the supports to the softening temperature of the support material and pressing the supports and the electrodes against each other, such that the support is pressed into a serrated clamping member formed in the electrode, after which the assembly of electrodes and supports is left to cool.

In an embodiment of the method according to the invention, forces are exerted on the material of the support with a force component transverse to the serrations while the supports and the electrodes are being pressed together.

BRIEF DESCRIPTION OF THE DRAWING

The invention will be explained in greater detail by means of several exemplary embodiments of the cathode ray tube according to the invention and with reference to the accompanying drawing, in which.

All Figures are diagrammatic representations, corresponding parts generally bearing the same reference numerals.

DESCRIPTION OF THE PREFERRED EMBODIMENTS

Figure 1:
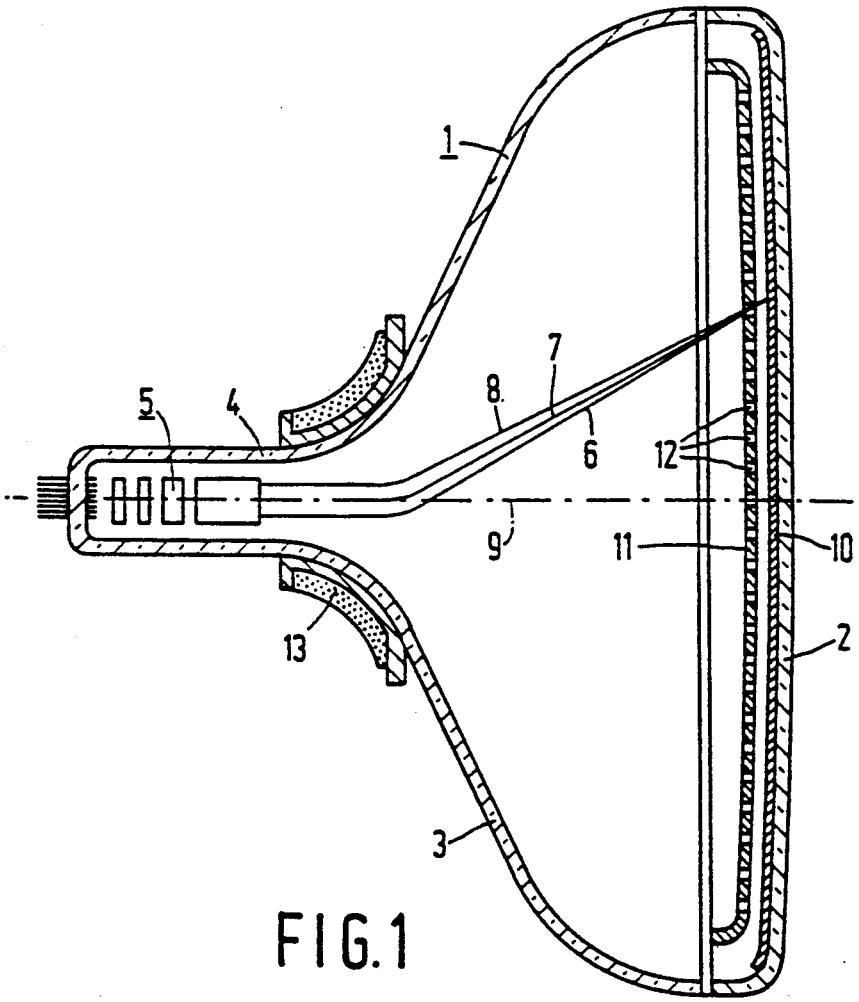
FIG. 1 is a sectional view of a cathode ray tube comprising an electron gun.

FIG. 1 is a sectional view of a cathode ray tube comprising an electron gun. In the present example, a colour display tube of the "in-line" type is shown. An electron gun 5 is provided in the neck 4 of a glass evacuated envelope 1 which is composed of a display window 2, a cone 3 and a neck 4, said electron gun generating three electron beams 6, 7 and 8 whose axes are located in the plane of the drawing. The axis of the central electron beam 7 initially coincides with the tube axis 9. A large number of triads of phosphor elements 10 are provided on the inside of the display window 2. Said elements may consist of, for example, lines or dots. In the present example, the display window contains linear elements. Each triad contains a line consisting of a phosphor luminescing in green, a line consisting of a phosphor luminescing in blue and a line consisting of a phosphor luminescing in red. Said phosphor lines extend transversely to the plane of the drawing. In front of the display screen 2 there is provided a shadow mask 11 having a large number of apertures 12 for passing the electron beams 6, 7 and 8 which each impinge only on phosphor lines of one colour. The three coplanar electron beams are deflected by the deflection coil system 13.

Figure 2:
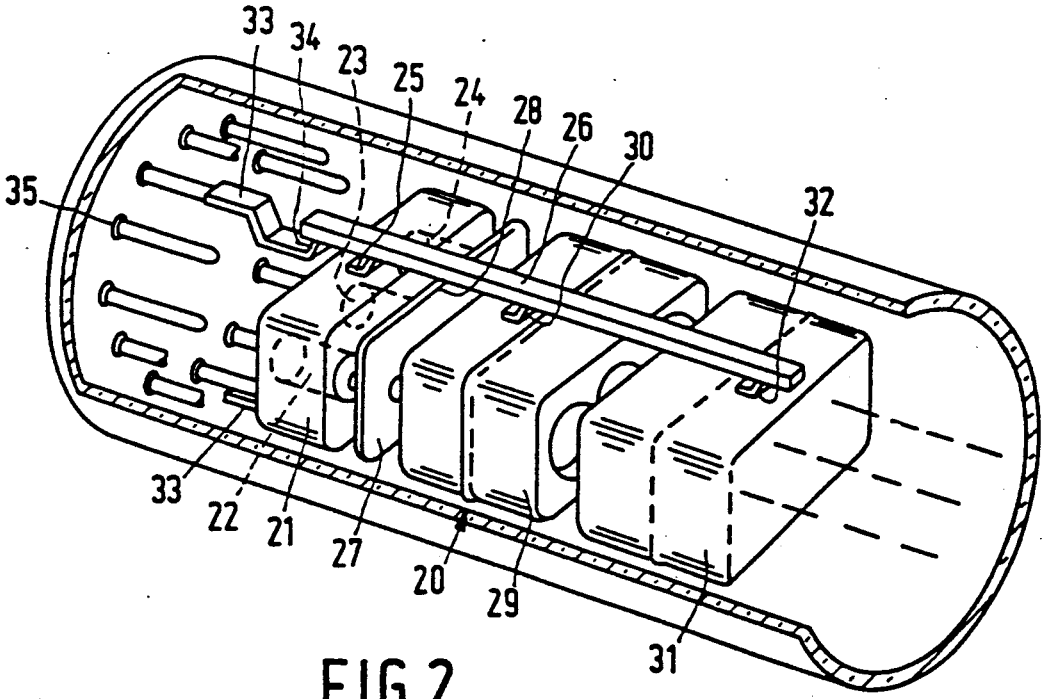
FIG. 2 is a partly perspective elevational view of an electron gun suitable for use in a cathode ray tube.

FIG. 2 is a partly perspective elevational view of an electron gun 20. The electron gun comprises a common control electrode 21 in which three cathodes 22, 23 and 24 are secured. Said common control electrode 21 is secured to supports 26 by means of securing members 25. The electron gun 20 further comprises a common plate-shaped electrode 27 which is connected to the supports through parts 28. The three coplanar electron beams are focused by a common electrode 29, which is provided with securing members 30, and a common electrode 31 which is provided with securing members 32. The supports are connected to feed-through pins 35 by means of supporting brackets 33 having securing members 34. In the present example, the electron gun 20 comprises two supports. The construction shown shall not be interpreted as limiting the scope of the invention. The electron gun may comprise more than two supports.

Figure 3:
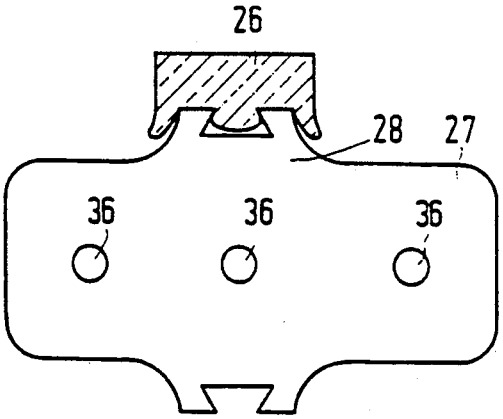
FIG. 3 PRIOR ART
FIG. 3 is a top view of an electrode suitable for use in a known cathode ray tube.

FIG. 3 is a top view of an electrode suitable for use in a known cathode ray tube. Said electrode, in the present example a plate-shaped electrode 27, is provided with projections 28 having a dovetailed recess. Said projections are pressed into the supports 26. The electrode comprises apertures 36 for passing the electron beams.

Figure 4:
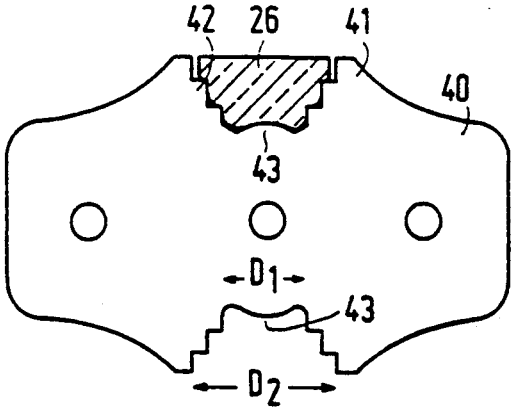
FIG. 4 is a top view of an electrode suitable for use in a cathode ray tube according to the invention.

FIG. 4 is a top view of an electrode 40 suitable for use in a cathode ray tube according to the invention. Electrode 40 comprises a clamping member 41 having serrations 42 between the bottom and the front at two facing sides of the clamping member. The support 26 is clamped by said serrations.

By virtue thereof, an improved connection between the electrodes and the supports is obtained. As a result of the larger clamping area, the fact of several clamping points instead of one pair and a larger distance between said clamping points, the stability of the connection has increased. Also the stability of the support has increased because the serrations do not penetrate the support as far as the projections. This results in a more stable construction and, hence, an improved microphonic behaviour of the electron gun. In addition, the electrode 40 is more rigid than the electrode 27 as a result of the shape of the clamping member, which also brings about an improved microphonic behaviour.

The bottom of the clamping member has a length $D_1$ and the front side of the clamping member has a length $D_2$. In this example, the bottom of the clamping member is smaller than the front side and the serrations are located between the bottom and the front side of the clamping member.

In the present example, a hillock 43 with an arcuate contour is formed on the bottom of the clamping member. This provides a means for exerting forces on the support which urge the material of the support to the serrations while the support and the electrode are being pressed together. By virtue thereof, the effectiveness of the serrations close to the bottom are improved.

Figure 5:
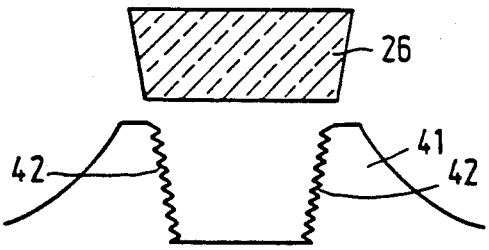
FIGS. 5 and 6 are top views of further examples of suitable electrodes.
Figure 6:
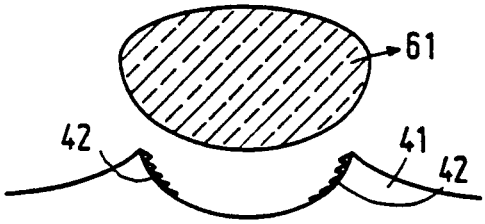

FIGS. 5 and 6 are top views of further examples of clamping members 41 of electrodes suitable for use in a cathode ray tube according to the invention. In FIG. 5, clamping member 41 forms an at least substantially U-shaped recess. In FIG. 6, clamping member 41 forms a recess in the form of a half arc. FIGS. 5 and 6 are also sectional views of supports 26 and 61. The shapes of said supports are adapted or matched to the shape of the clamping member.

Figure 7:
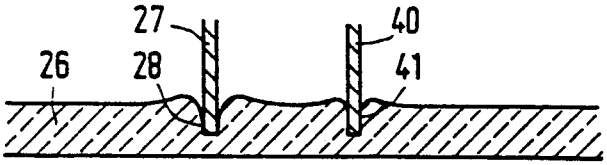
FIG. 7 is a sectional view of a support to which an electrode is attached.

FIG. 7 is a sectional view of a support 26. In said support 26 there are secured two electrodes, electrode 27 as shown in FIG. 3 having a projection 28, and electrode 40 as shown in FIG. 4 having a clamping member 41. It has been found that during the interconnection of the electrodes and the support, said support exhibits less deformation next to electrode 40 than next to electrode 27. FIG. 7 shows how the use of the known electrode causes the support to bulge in the immediate vicinity of the electrode 27, which does not happen, or to a much lesser extent, in the direct vicinity of the electrode 40. As a result thereof, fewer stresses occur in the carrier. The risk of fracture is reduced and the accuracy with which the electrode is positioned is improved. In addition, the loading of the support is reduced.

Figure 8A:
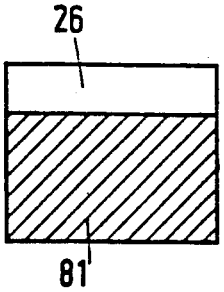
FIGS. 8*a* to 8*c* are sectional views of a support, in which Figures the parts which are heated to the softening temperature are indicated.
Figure 8B:
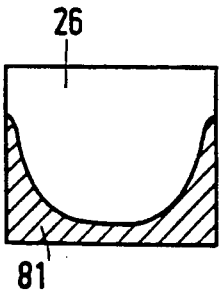
Figure 8C:
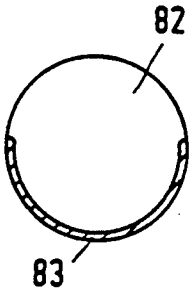

FIGS. 8*a*, 8*b* and 8*c* illustrate a further advantage of the invention. Supports 26 and 81 are shown in section. The hatching in FIG. 8*a* indicates the portion 81 which has to be heated to at least the softening temperature when the support and the electrode 27 are interconnected. FIG. 8*b* shows the portion 81 which has to be heated to the softening temperature when an electrode 40 having a clamping member 41, as shown in FIG. 4, is used. This is a smaller portion than the portion 81 in FIG. 8*a*. By virtue thereof, a saving of time can be attained and the electrode can be more accurately positioned relative to the support. FIG. 8*c* shows a support whose shape is adapted to that of the clamping member shown in FIG. 6. In this case, the portion 83 to be heated to the softening temperature is even smaller than in FIG. 8*b*.

Figure 9A:
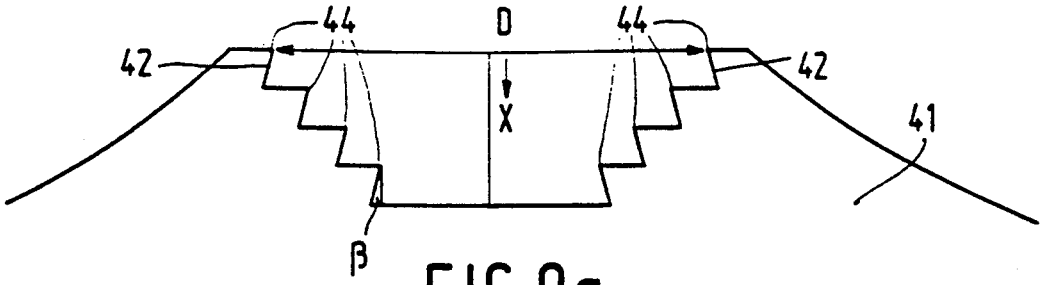
FIG. 9*a* is a top view of a part of an electrode.
Figure 9B:
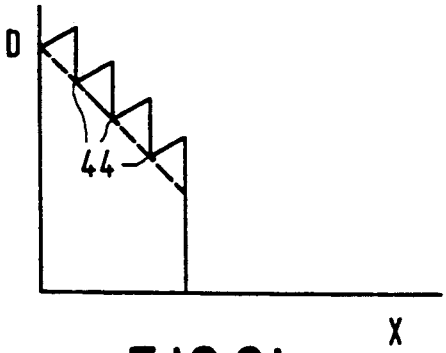
FIGS. 9*b* and 9*c* are graphic representations of the shape of the clamping member.
Figure 9C:
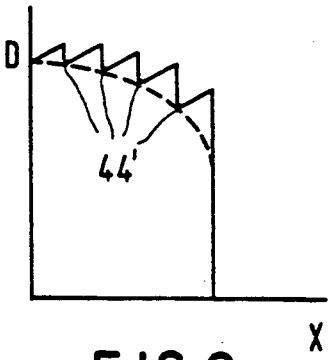

FIG. 9*a* is a top view of a clamping member 41 having serrations 42. The distance D between the serrations 42 varies as a function of x, in such a manner that for the points 44 the distance D exhibits a local minimum. This is graphically shown in FIGS. 9*b* and 9*c*. After cooling, the clamping member clamps the support through the points 44 (FIG. 9*b*) or 44' (FIG. 9*c*).

Figure 10A:
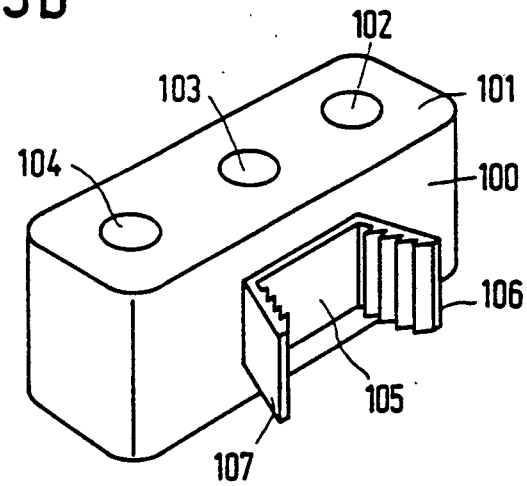
FIGS. 10*a* and 10*b* are perspective and top views, respectively, of a box-shaped electrode.
Figure 10B:
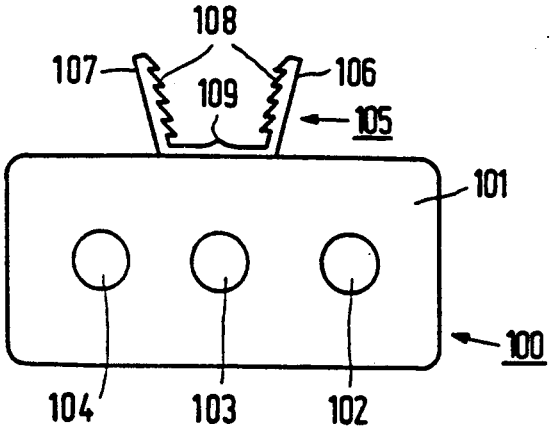

In an embodiment, the clamping member may be formed by two plate-shaped elements which are serrated on the inside as shown in FIGS. 10*a* and 10*b*. By virtue thereof, the connection can be further improved.

FIGS. 10*a* and 10*b* are perspective and top views, respectively, of a box-shaped electrode 100. In the top surface 101 there are provided apertures 102, 103 and 104. A bracket 105 is provided at a side wall. Said bracket 105 contains two plate-shaped elements 106 and 107, the facing sides of which are provided with serrations 108.

It will be obvious that many variations are possible within the scope of the invention. In the present example, an "in-line" colour display tube is shown. This is not to be interpreted in a limiting sense. The cathode ray tube may be a monochrome display tube, for example, a projection cathode ray tube. The cathode ray tube may be an oscilloscope cathode ray tube or any other type of cathode ray tube. Within the scope of the invention, "clamping member" is to be understood to mean, inter alia, a straight or conical embracing member such as, for example, a recess as shown in FIGS. 4, 5, 6 and 9*a* or, for example, a duct as shown in FIGS. 10*a* and 10*b*. "Serrations" are to be understood to include also ridges and barbs. A "serrated clamping member" is to be understood to mean herein an embracing element having two facing sides which are provided with serrations. The support is clamped in the clamping member by means of said serrations.

I claim:

1. A cathode ray tube comprising an electron gun having at least one electrode and at least one support made of a material which can be softened, the support and the electrode being interconnected, characterized in that the electrode is provided with a serrated clamping member in which the support is held, the serrations in the clamping member clamping said support at the periphery of the support.

2. A cathode ray tube as claimed in claim 1, characterized in that the shape of the support matches to the shape of the clamping member.

3. A cathode ray tube as claimed in claim 1, or 2, characterized in that a hillock is formed on the bottom of the clamping member.

4. A cathode ray tube as claimed in claim 1 or 2, characterized in that the serrations are formed such that the distance between the serrations, as a function of the distance to the bottom of the clamping member in a direction transverse to the bottom, exhibits local minima.

5. A cathode ray tube as claimed in claim 1 or 2, characterized in that the clamping member comprises two plate-shaped elements having facing sides which are provided with serrations.

6. A cathode ray tube as claimed in claim 1 or 2, characterized in that the electron gun comprises more than one electrode and more than one support.

7. A cathode ray tube as claimed in claim 1 or 2, characterized in that the bottom of the clamping member is smaller than or equally as large as the front side of the clamping member and the serrations are located between the bottom and the front side of the clamping member.

8. A cathode ray tube as claimed in claim 7 wherein a hillock is formed on the bottom of the clamping member.

9. A cathode ray tube as claimed in claim 7 wherein the clamping member comprises two plate-shaped elements having facing sides provided with serrations.

10. A method of manufacturing an electron gun for a cathode ray tube which comprises:

providing at least one electrode of the electron gun with a serrated clamping member, interconnecting said at least one electrode of the electron gun and at least one support member made of a softenable material by heating the support member to the softening temperature of the support material and pressing the support member and the electrode against each other such that the support member is pressed into the serrated clamping member of the electrode, after which the assembly of electrode and support member is left to cool.

11. A method as claimed in claim 10 which further comprises; exerting forces on the material of the support member with a force component transverse to the serrations while the support member and the electrode are being pressed together.

12. A cathode ray tube comprising:

an envelope containing a display screen, an electron gun within said envelope for producing an electron beam directed towards said display screen, a beam deflection apparatus, said electron gun including a plurality of electrodes, at least one support member for the electrodes and which is made of a heat softenable material, and wherein at least one of the electrodes of the electron gun includes a serrated clamping member in which the serrations in the clamping member clamp said support member at the periphery of the support member thereby to fasten said one electrode to the support member in a manner so as to reduce the microphonic response of the electron gun.

13. A cathode ray tube as claimed in claim 12 wherein the shape of the support member is complementary to the shape of the clamping member so as to provide a good fit therebetween.

14. A cathode ray tube as claimed in claims 12 or 13 wherein at least a part of the bottom of the clamping member contains a protuberance extending toward the front end of the clamping member in a manner so as to urge the serrations into the support member.

15. A cathode ray tube as claimed in claims 12 or 13 wherein the space at the bottom of the clamping member is at most equal to the space at the front end of the clamping member and the serrations are located in confronting relationship between the bottom and the front end of the clamping member.

16. A cathode ray tube as claimed in claim 15 wherein at least a part of the bottom of the clamping member contains a protuberance extending toward the front end of the clamping member in a manner so as to urge the serrations into the support member.

* * * * *